United States Patent [19]

Hsu

[11] Patent Number: 4,934,548

[45] Date of Patent: Jun. 19, 1990

[54] LIQUID CONTAINER

[76] Inventor: Yung C. Hsu, 4th Fl., No. 12, Lane 251, Tsun Hsien Street, Pei Tou, Taipei, Taiwan

[21] Appl. No.: 334,136

[22] Filed: Apr. 6, 1989

[51] Int. Cl.[5] ..... B65D 51/00

[52] U.S. Cl. ..... 215/307; 222/111

[58] Field of Search ..... 222/109, 111; 215/307

[56] References Cited

U.S. PATENT DOCUMENTS 2,743,844 5/1956 Livingstone ..... 222/111

4,802,597 2/1989 Dubach ..... 222/111 X

*Primary Examiner*—Stephen Marcus

*Attorney, Agent, or Firm*—Shoemaker and Mattare, Ltd.

[57] ABSTRACT

A container designed so that after pouring out a liquid therefrom, any liquid inadvertently remaining on and running down the outside surface of the container opening can be returned to the inside of the container so that the container and its storage place will not be dirtied by the liquid and other foreign material. The container includes a guiding piece having a tubular piece and a drain hole, a cap, and a stopping annulus having a ring which passes through the tubular piece, has a diameter smaller than that of the open top of the container body but larger than that of the tubular piece, and includes an upper end lower than that of the tubular piece and a lower end higher than a bottom portion of the open top. A liquid guiding device is provided for guiding out of the container the liquid contained therein.

2 Claims, 1 Drawing Sheet

LIQUID CONTAINER

BACKGROUND OF THE INVENTION

The present invention relates to a container, and more particularly to a liquid container.

It is often experienced that after pouring a liquid out of a container, a quantity of liquid remains on the outside surface of the container opening. Sometimes, a relatively large quantity of liquid will even run down along the outside surface of the container. This phenomenon occurs not only with liquid containers used at home but also with those used in industry and results not only in the container itself being easily contaminated but also that the storage place becomes dirty, both of which are not only disgusting but are also extremely troublesome. In order to cope with this phenomenon, several attempts have been made to modify the shape of a container opening which, nevertheless, has had no effect on liquids with a relatively high viscosity and had little effect on liquids having a relatively low viscosity.

It is therefore the object of this inventon to provide an improved liquid container whose outside surfaces around the opening will not be contaminated by liquid remaining around the container opening.

SUMMARY OF THE INVENTION

The present invention offers a liquid container which includes a container body having an open top, a quiding piece having a tubular piece and an annular piece having therein a drain hole and attached to the open top, a stopping annulus having a ring which has a diameter smaller than that of the open top but larger than that of the tubular piece and includes an upper end lower than that of the tubular piece and a lower end higher than a bottom portion of the annular piece, a cap, and a liquid guiding means connected to the upper end of the tubular piece for guiding therefrom a liquid poured out of the container.

Certainly, the guiding means can be a cover having a liquid guiding port positioned diametrically opposite with respect to the drain hole. Alternatively the guiding means can be a liquid guiding port integrally formed in the upper end of the tubular piece.

Certainly, the guiding piece and the open top of the container body can be integrally formed together.

The present invention may best be understood through the following description with reference to the accompanying drawings, in which:

DETAILED DESCRIPTION OF THE PREFERRED EMBODIMENT

Figure 1:
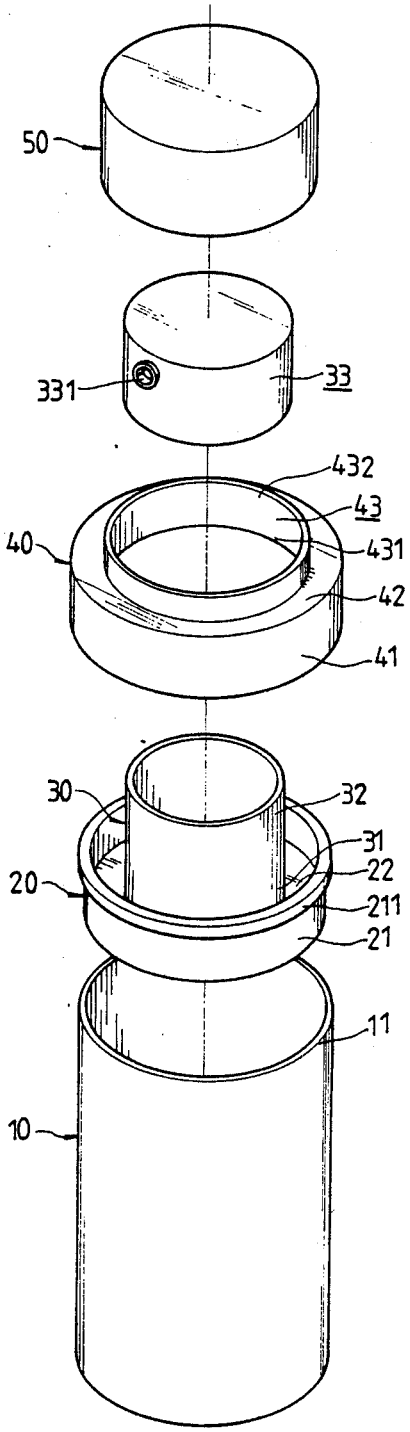
FIG. 1 is an exploded view of a preferred embodiment of a liquid container according to the present invention.
Figure 2:
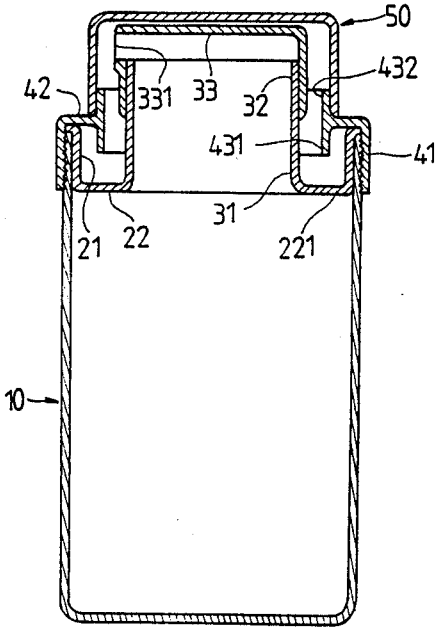
FIG. 2 is a sectional view showing the liquid container in FIG. 1.

Referring now to FIGS. 1 and 2, a first preferred embodiment of a liquid container according to the present invention includes a container body 10 having an open top 11, a guiding piece 20, a tubular piece 30 integrally formed with guiding piece 20, a stopping annulus 40, a cap 50, and a liquid guiding means 33. Guiding piece 20 consists of a vertical piece 21 having a top flange 211 and attached in and against open top 11 and a horizontal piece 22 having therein a drain hole which communicate the inner side and the outer side of horizontal piece 22.

Stopping annulus 40 has a first ring 41 screwed on to open top 11, a horizontal connecting annulus 42 urging against top flange 211, and a second ring 43 through which coaxially passes tubular piece 30, a lower end 31 and an upper end 32 and has a diameter smaller than that of open top 11 but larger than that of tubular piece 30 and includes an upper end 432 lower than upper end 32 and a lower end 431 higher than horizontal piece 22.

Liquid guiding means 33, being a cover in the present embodiment, includes a side port 331 positioned diametrically opposite with respect to drain hole 221 when attached to upper end 32. Cap 50 covering thereunder cover 33, upper end 32 and upper end 432, can prevent foreign matter, e.g. dust or insects, from entering into annular piece 21, 22 and container body 10.

After first removing cap 50 and pouring a desired amount of the liquid from side port 331 out of container body 10 during which time drain hole 221 can act as an air vent, any quantity of liquid which inadvertently remains on the outside surface of cover 33 will run down through tubular piece 30 into the space defined between lower end 31 and annular pieces 21, 22 to be returned to container boby 10 through drain hole 221 when the container is placed upright. If a second pouring follows immediately, the liquid in the space not yet returned to container body 10 wil1 be confined in the space between vertical piece 21, connecting annulus 42 and lower end 431 without the possibility of escaping out of the container.

Figure 3:
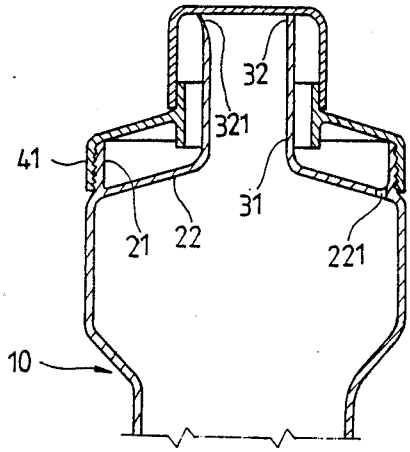
FIG. 3 is a sectional view showing a further preferred embodiment of a liquid container according to the present invention.

As shown in FIG. 3, a second preferred embodiment of the present liquid container differs from the first preferred embodiment above described in that the open top of container body 10, guiding piece 20 and tubular piece 30 are integrally formed together, and the liquid guiding means is a liquid guiding port 321 integrally formed on upper end 32 in order to simplify the structure of the present liquid container.

It should now become readily apparent through the above description how and why the present liquid container can achieve the objects it contemplates.

The above described embodiments are for illustrative purposes only and do not limit the scope of the invention. Any changes, modifications and applications made on the basis of the spirit of the present invention should be interpreted to fall within the scope of the appended claims.

What I claim is:

1. A liquid container comprising:

a container body having an open top;

a guiding piece having an annular piece attached to said open top and having therein a drain hole which communicates the inner side and the outer side of said guiding piece, and a tubular piece having a diameter smaller than that of said open top;

a stopping annulus attached to said open top and having a ring which passes therethrough said tubular piece, has a diameter smaller than that of said open top but larger than that of said tubular piece, and includes an upper end lower than that of said tubular piece and a lower end higher than a bottom portion of said annular piece;

a cap capable of covering the upper ends of said tubular piece and said ring; and a cover attached to said upper end of said tubular piece for guiding out of said container a liquid contained in said container, said cover having a liquid guiding port positioned diametrically opposite with respect to said drain hole.

2. A liquid container according to claim 1 wherein said guiding piece and said open top are integrally formed together.

* * * * *